US006029593A

United States Patent [19]

Migliorini

[11] Patent Number: 6,029,593

[45] Date of Patent: Feb. 29, 2000

[54] METHOD AND APPARATUS FOR APPLYING A GUSSET TO TEXTILE ARTICLES SUCH AS PANTYHOSE AND THE LIKE

[75] Inventor: Pier Lorenzo Migliorini, Terranuova Bracciolini, Italy

[73] Assignee: Matec S.P.A., Scandicci, Italy

[21] Appl. No.: 09/148,617

[22] Filed: Sep. 4, 1998

[30] Foreign Application Priority Data

May 26, 1998 [IT] Italy ..... FI98A0125

[51] Int. Cl.[7] ..... D05B 21/00

[52] U.S. Cl. ..... 112/475.12; 112/470.15

[58] Field of Search ..... 112/435.12, 470.15, 112/152, 470.33, 113, 470.28, 122.3, 470.08, 475.06, 304; 2/401; 83/94, 152

[56] References Cited

U.S. PATENT DOCUMENTS

| | | | |
|---|---|---|---|
| 4,122,555 | 10/1978 | Safrit et al. | 2/401 |
| 4,188,898 | 2/1980 | Bell, Jr. et al. | 112/470.15 |
| 4,267,785 | 5/1981 | Osho | 112/470.08 |
| 4,433,774 | 2/1984 | Lopes | 83/94 |
| 4,461,197 | 7/1984 | Seaman | 83/152 |
| 4,640,162 | 2/1987 | London et al. . | |
| 4,704,976 | 11/1987 | London et al. . | |
| 5,167,197 | 12/1992 | Lavelle et al. | 112/475.06 X |
| 5,277,139 | 1/1994 | Honeycutt | 112/152 X |
| 5,456,193 | 10/1995 | Boot | 112/304 X |

*Primary Examiner*—Ismael Izaguirre
*Attorney, Agent, or Firm*—McGlew and Tuttle, P.C.

[57] ABSTRACT

Apparatus for the formation of gussets to be applied in the crotch region of pantyhose articles upon the assembly thereof on a machine having a plurality of shapes (2) over which the stockings to be assembled to form pantyhose articles are fitted in pairs, the gussets being formed out of a ribbon (30), coming from a relevant input section (I), by a cutter (4) located downstream of the section (I), characterized in that it comprises a first plane (7) upstream of the cutting unit (4), a second and a third plane (8, 9) each of which is apt to engage a corresponding side of the ribbon (30), the second plane (8) being moveable from and to the ribbon (30)—inputting section (I) and the third plane (9), located downstream of the cutting unit (4), being moveable between a position in which it results in face-to-face relationship with the second plane (8) and a position in which it engages the individual gussets (66) already formed, in an arrangement suitable for the transfer thereof to the crotch region of the pantyhose article.

10 Claims, 7 Drawing Sheets

METHOD AND APPARATUS FOR APPLYING A GUSSET TO TEXTILE ARTICLES SUCH AS PANTYHOSE AND THE LIKE

FIELD OF THE INVENTION

The present invention refers to a method and apparatus for applying a gusset to textile articles such as pantyhose and the like.

BACKGROUND OF THE INVENTION

As known to those skilled in the art, a pantyhose article provided with a gusset is obtained starting from a product obtained by assembling two stockings sewn together to form the pantyhose bodice and without sewing them in correspondence of the crotch region. Provision is made afterwards for stretching the edge of the seamless region of said article according to the shape of the gusset to be applied, bringing close thereto a gusset having a shape and dimensions suitable for covering the region without fabric of the thus stretched article, and eventually sewing the gusset to the article which is subsequently unloaded at an operating station other than that for applying and sewing the gusset. To this end, a device for the application of the gussets is associated to the machine that provides for the assembly of the stockings, said device being provided at an operating station downstream of the stations in which the loading, positioning, longitudinal cutting and sewing together of the two stockings intended to form the pantyhose article are carried out.

The devices presently known for gusset application, especially those intended for applying rhomboid gussets, comprise means for feeding a fabric ribbon from which the gussets are formed, means for cutting the ribbon into rhomboid gussets, the cut being oriented with respect to the longitudinal axis so as to form an angle therewith of a predetermined amplitude corresponding to the wanted length of the rhombus diagonals, and means for taking out the thus formed gussets and moving them from the gusset-forming region to the region where the same gussets are applied on the stockings to be assembled.

A drawback with these known devices lies in the fact that the formation of a gusset out of the said ribbon is possible only after the application of the gusset previously formed. In other words, each gusset can be formed only after the previous gusset has been transferred in correspondence of the shapes of the machine that assembles the stockings into pantyhose articles. As a consequence, the time of the cycle for the formation and application of the gussets results too long in relation to the current production requirements.

U.S. Pat. Nos. 4,704,976 and 4,640,162 disclose an apparatus and a method for the formation and application of rhomboid gussets on stockings to be assemble into pantyhose articles.

SUMMARY AND OBJECTS OF THE INVENTION

The main object of the present invention is to provide a system for forming and moving rhomboid gussets for pantyhose articles which makes it possible to significantly reduce the time for the relevant cycle.

A further object of the present invention is to ensure a more effective action for retaining the gussets in the process of formation.

This result has been achieved, according to the invention, by providing an apparatus and a method with a first plane having a first end for receiving the ribbon. A cutter is positioned adjacent a second or downstream end of the first plane and cuts the ribbon into a plurality of gussets. A second plane is moveably positioned with respect to the first plane in a direction toward and away from the first end of the first plane. The second plane has engaging means for engaging with the ribbon. The ribbon is moved along the first plane by engaging the second plane with the ribbon and moving the second plane away from the first plane. A third plane is arranged adjacent the cutter and on a side of the cutter diametrically opposite the first plane. The third plane has engaging means for engaging with the ribbon and a gusset. The third plane is moveable between a first position substantially face-to-face with the second plane and a second position with the gusset adjacent to the shape machine for transfer of the gusset to the shape machine. The third plane engages the gusset to the first position of the third plane. The third plane then moves itself and the gusset away from the second plane and to the second position of the third plane for the transfer of the gusset to the shape machine. Further characteristics being set forth in the dependent claims.

The advantages deriving from the present invention lie essentially in that it is possible to reduce the time of the whole cycle for the formation and application of the gussets, thereby reducing the time for the manufacturing of the article provided with gusset; that during the handling of the individual gussets, the latter result engaged and moved more effectively and safely than it is allowed by the devices presently known; that an apparatus according to the invention is simple to make, relatively cost-effective and reliable even after a prolonged life service.

These and other advantages and characteristics of the invention will be best understood by anyone skilled in the art from a reading of the following description in conjunction with the attached drawings given as a practical exemplification of the invention, but not to be considered in a limitative sense.

DESCRIPTION OF THE PREFERRED EMBODIMENT

Figure 1:
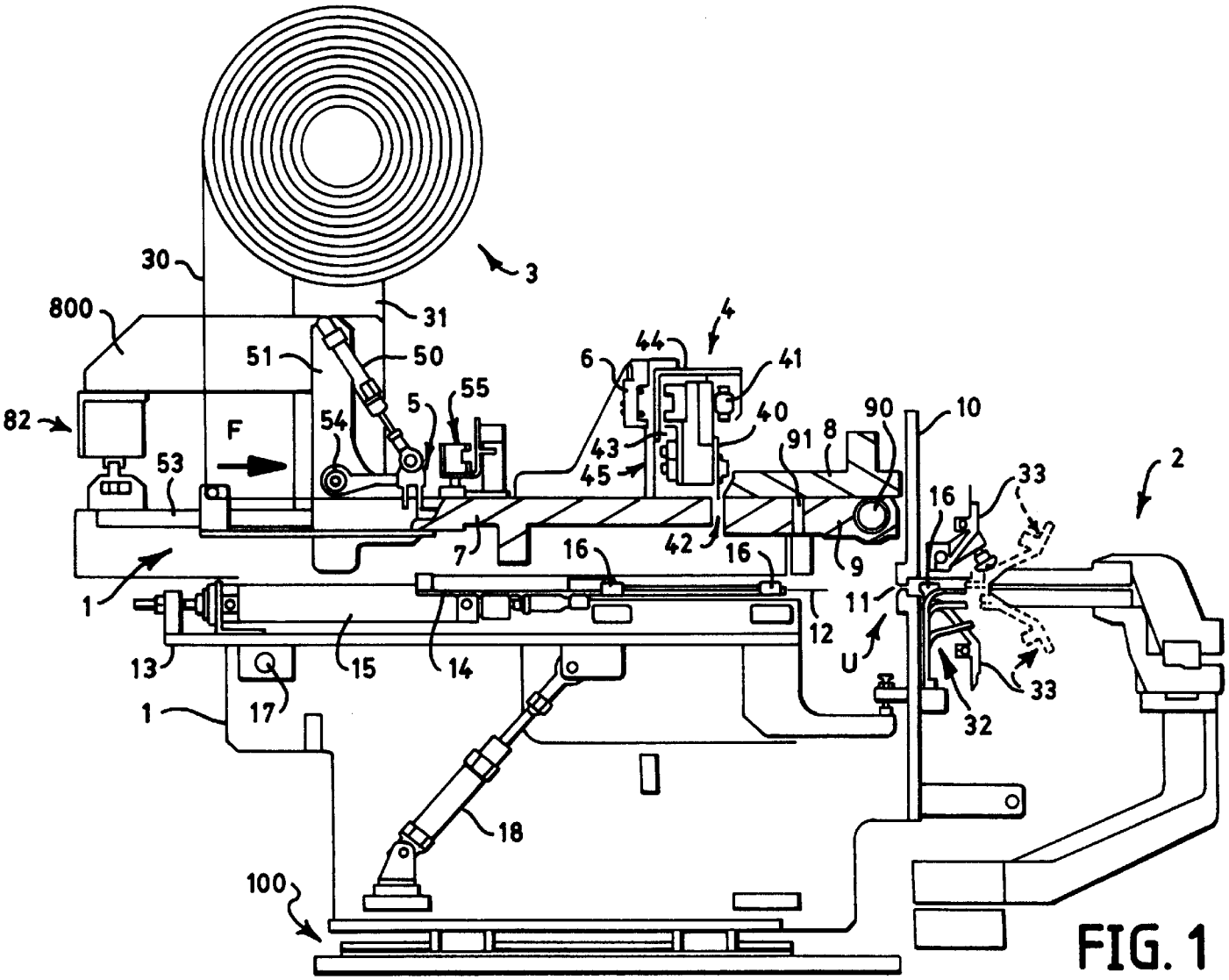
FIG. 1 is a schematic sectional view, taken through a plane orthogonal to the working axis of the cutter, of an apparatus according to the invention in the process of forming a gusset.
Figure 2:
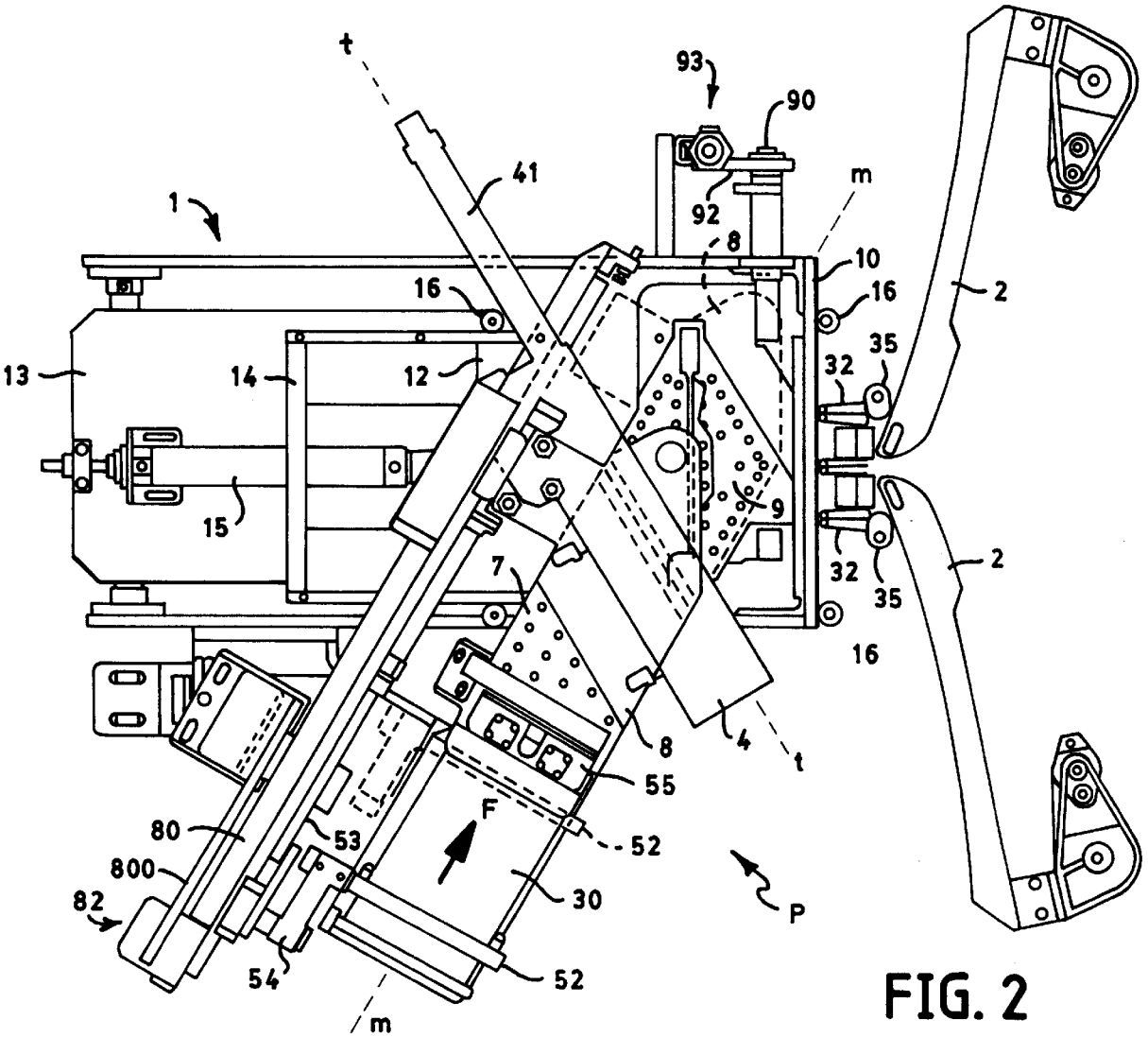
FIG. 2 is a schematic plan view of the apparatus of FIG. 1, showing in particular the ribbon-feeding and gussets-forming plane, the shapes of the machine for assembling the pantyhose articles, and the means for the transfer of the gussets from the said formation plane to the same shapes.
Figure 3:
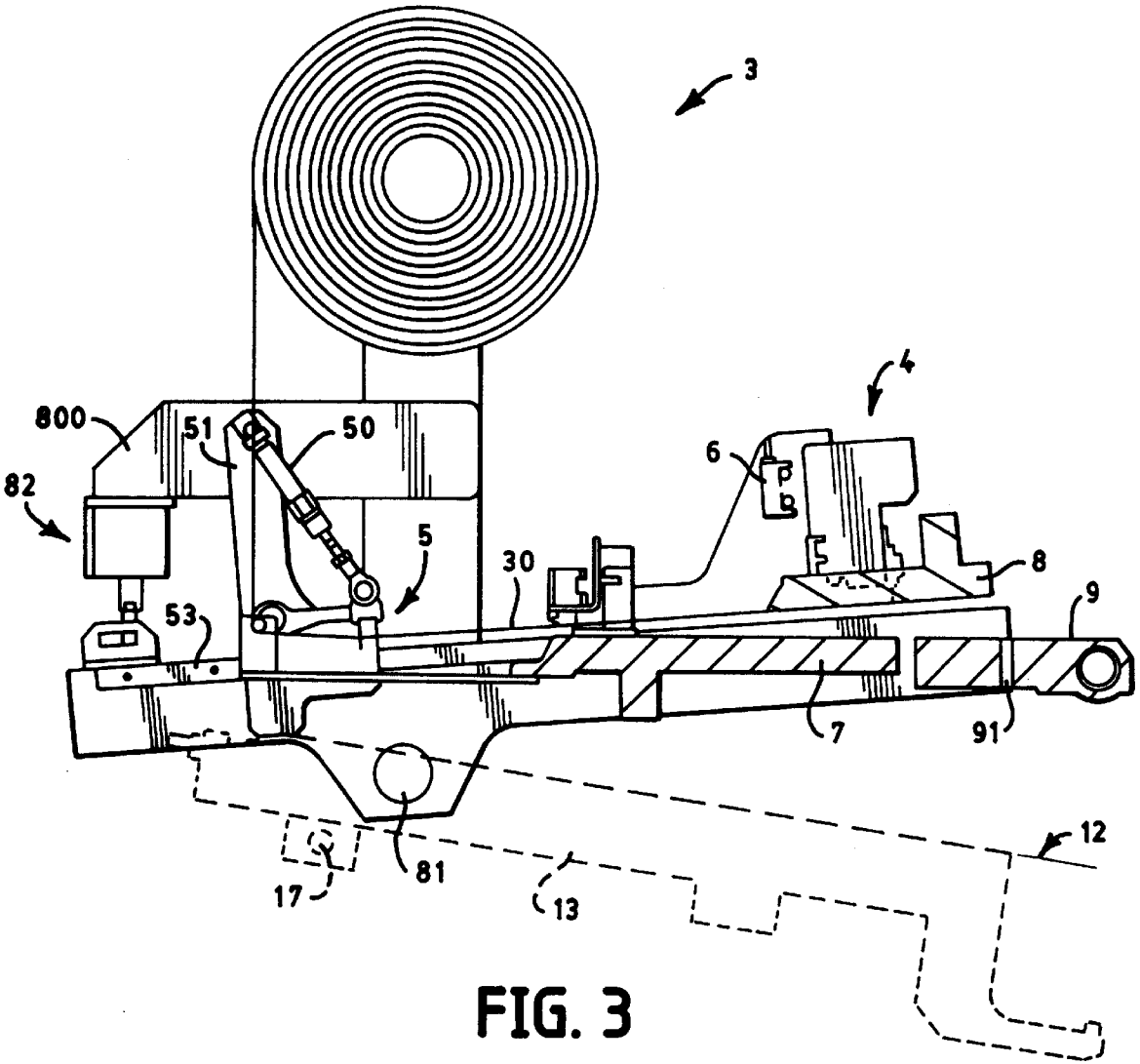
FIG. 3 shows a detail of the apparatus in section view similar to that of FIG. 1, in the configuration taken up prior to the transfer of a gusset.

The apparatus according to the invention is intended for placement into a corresponding operating station of a horizontal carrousel machine, for example of "line closer" type, for the assembly of pantyhose articles, downstream of the stations in which, according to procedures known to the experts in the field, the operations for loading, positioning, longitudinal cutting and sewing together the stockings are performed. In the figures of the attached drawings, the only parts shown of this machine are the shapes (2) which support the stockings during the work, the shapes (2) being disposed, in the gussets-application station, in open condition, that is, with the stocking legs being suitably stretched apart to receive a corresponding gusset. In this station, the stockings result already sewn in correspondence of the bodice, save for the crotch region where the gusset must be applied.

The apparatus in question has a base (1) with a substantially box-like structure and a support (31) for a ribbon reel of textile material from which the individual gussets are formed. The said base (1) has a section (I) for the introduction of the ribbon (30) to be cut and a section (U) for the exit of the already formed gussets, that is, the gussets cut out of the ribbon (30) and rotated (as described in more details later on) to allow for the application thereof on the pantyhose in the process of formation. The base (1) supports a cutter (4) intended to cut the ribbon (30) into lengths, that is, into rhomboid gussets of preset width. To this end, the said cutter (4) is positioned onto the base (1) so that the cutting direction of the ribbon (30) will form an angle of predetermined amplitude with the axis (m-m) of advancement thereof onto the relevant plane (P) of the structure (1). To form a gusset of desired dimension out of the ribbon (3), the latter is pulled out and made to advance (according to the direction of arrow F), until its front edge goes through a corresponding extent beyond the sight represented by the action line (t-t) of the blade (40) of cutter (4), to then activate the latter and cut the ribbon (30) at the height of said line. The handling of the blade (40) is obtained by a respective actuator (41) having axis parallel to the ribbon (30)—cutting direction (t-t). The blade (40), associated to the actuator (41), rolls relative to a counterblade (42). The rolling of the blade (40) is caused by the interaction of a pinion (43), solid to the cutter's fixed structure (44), with a pair of gear wheels (45) the first of which meshes with the toothing of the pinion (43), while the other meshes with the first gear and is keyed on the axis of rotation of the blade (40). Provided upstream of the cutter (4) is a gripper (5) between the jaws of which the ribbon (30) to be cut is passed. Said gripper (5) is mounted on the base (1) and is able to translate to and from the cutter (4). To this end, the gripper (5) is associated to a carriage (51) which slides under control of an actuator along a straight guide (53) extending parallel to the feeding direction (F) of the ribbon (30) which moves onto the plane (P) of the base structure (1). The activation of the gripper (5), in the direction of opening and closing of the respective jaws, is achieved by an actuator (50) whose skirt is pivoted to said carriage (51) and whose rod is pivoted to the upper jaw (52) of gripper (5), the said jaw (52) being in turn engaged to the carriage (51) by means of a hinge (54) having its axis orthogonal to the feeding direction (F) of the ribbon (30) moving onto the plane (P). An optical barrier (6) is provided at an intermediate position between the cutter (4) and the gripper (5) to detect any deviation of the moving ribbon (30). Mounted below the cutting unit (4) is a first, steady, suction plate (7) so that the ribbon (30) to be cut results interposed between the said unit (4) and the first suction plate (7) itself. The function of said plate (7) is to be described later on. Mounted downstream of the cutter (4) are a second suction plate (8) located above the ribbon (30)—sliding plane and a third suction plate (9) located below the second plate (8). The second suction plate (8) is mounted, likewise the gripper (5), in a way that enables it to translate from and to the cutter (4) onto the ribbon (30)—feeding plane (P) under control of a relevant actuator (not shown in the figures of the attached drawings). The said third suction plate (9) is mounted for rotation about a horizontal axis (90) oriented parallel to the front side of the base structure (1). In this way, the said third plate (9) may be disposed horizontally, upon the formation of the gussets, that is, during the ribbon (30)—cutting phase, and vertically, in correspondence of the section (U) for the exit of the gussets, to allow the latter to be transferred from said plane (p) to the stockings being present on the shapes (2). The rotation of the plate (9) is operated by an actuator (93) having a vertical axis connected to the shaft (90) via a small arm (92).

The suction plate (8) is advantageously mounted, as above mentioned, movable on one arm (80) which develops laterally and parallel to the plane (P) for the advancement of the ribbon (30) and the formation of the gussets (66), the same arm being angularly mounted for oscillation on the axis (81) orthogonal to the direction (F) of the ribbon (30) to be cut, the latter being located below the fixed suction plate (7). The angular oscillation of the arm (80), which supports also the gripper (5) (with the relevant support 51 and the actuator 50), the cutter unit (4) and the optical sensors (6), is operated by an actuator (82) to which a cantilevered appendix (800) of the arm (80) is associated. The upward rotation of the arm (80) is intended for moving the suction plate (8) out of contact with the underlying plates (7, 9) when the ribbon (30) is to be fed for cutting it as desired.

Mounted above said plane (P), between the gripper (5) and the cutter (4), is a scraper (55) whose function is to prevent any waviness in the ribbon (30) sliding therebelow. The scraper (55) being supported by the said arm (80).

To insert the gussets (66) into the crotch region of the pantyhose article, that is, to transfer the gussets (66) to the shapes (2) from the exit section (U)—the latter being located in correspondence of the front side (10) of the structure (1) and being delimited by a horizontal slit (11) of said side (10)—a lamina (12) is used. The said lamina (12) is mounted on a platform (13) disposed below said plane (P) of the structure (1) and is fixed to a frame (14) sliding onto the platform (13) from and to the said slit (11) of the structure (1). The dimensions and shape of the lamina (12) are such as to allow it to be introduced through the slit (11) and through a slit (91) of the rotary suction plate (9), the said slits (11) and (91) being in alignment when the plate (9) is disposed in vertical position. The frame (14) is associated to an actuator (15) which allows for the advancement thereof along with the lamina (12) during the insertion of the gussets (66) and their subsequent return to a standby or rest position. The movement of the frame (14) is assisted by a set of guide wheels (16) fixed to the platform (13) and provided both inwardly and outwardly of the structure (1). To reduce the overall dimensions of the apparatus, the platform (13) is mounted for angular oscillation on a horizontal axis (17), that is, orthogonal to the axis of translation of the lamina (12), under control of a cylinder (18) whose rod is connected to the lower side of the platform (13). The platform (13) is rotated downwards to clear the area of transit of plate (9) when the latter is rotated downwards to be disposed with the respective slit (91) in correspondence of the slit (11) for the exit of gussets (66). Alternatively, the platform (13) is fixed. In this case, it is located in a position more retracted than the one represented in the figures of the attached drawings. The whole structure (1) may be mounted on a straight guide (100) to be disposed either in an advanced work position (as in FIG. 1) or in a retracted rest position (as when the gussets must not be applied on the pantyhose articles). The structure (1) is driven into motion, in this case, by an actuator (101) having horizontal axis. Provided externally to the structure (1), in correspondence of the section (U) for the exit of the gussets (66), are means to assist the very application of the latter. The said means, which are well known to those skilled in the art, comprise: a set of nozzles (32) which serve to dispose the lower edge of the gussets (66) out of the sewing area, the sewing of the gussets concerning first the upper (660) and then the lower (661) edge; elastic reeds (33) movable from and to the shapes (2); pressers (34) for retaining the edges of the stockings fitted over the shapes (2) in a condition suitable for receiving the gussets (66); pressers (35) for retaining the upper edge (660) of the gussets (66) on the insertion lamina (12) while the nozzles blow air onto the lower edge (661) of the same gussets. The process implemented according to the invention is as follows.

Figure 4:
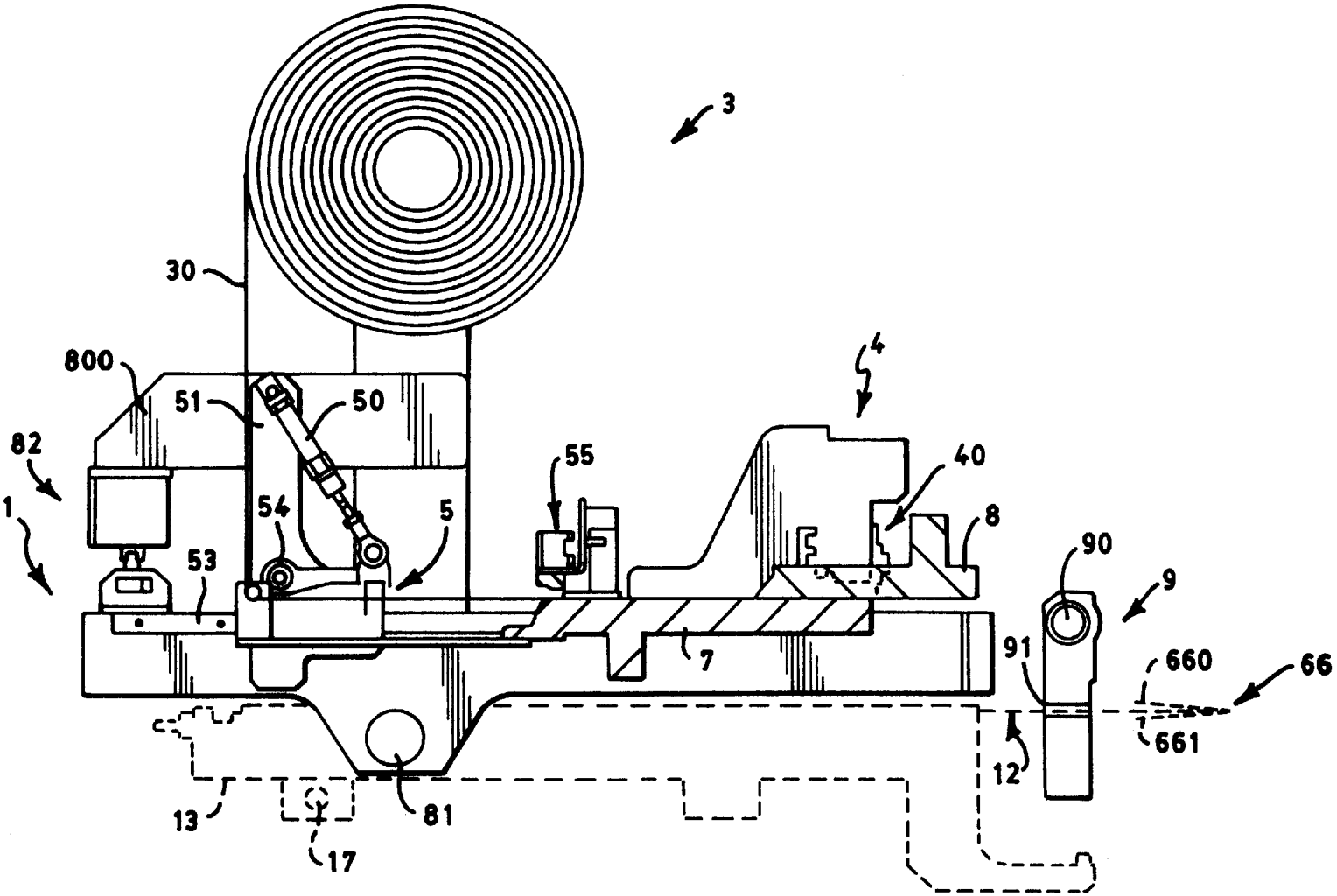
FIG. 4 shows the detail of FIG. 3 with the gusset in the process of being transferred to the pantyhose-supporting shapes.
Figure 5:
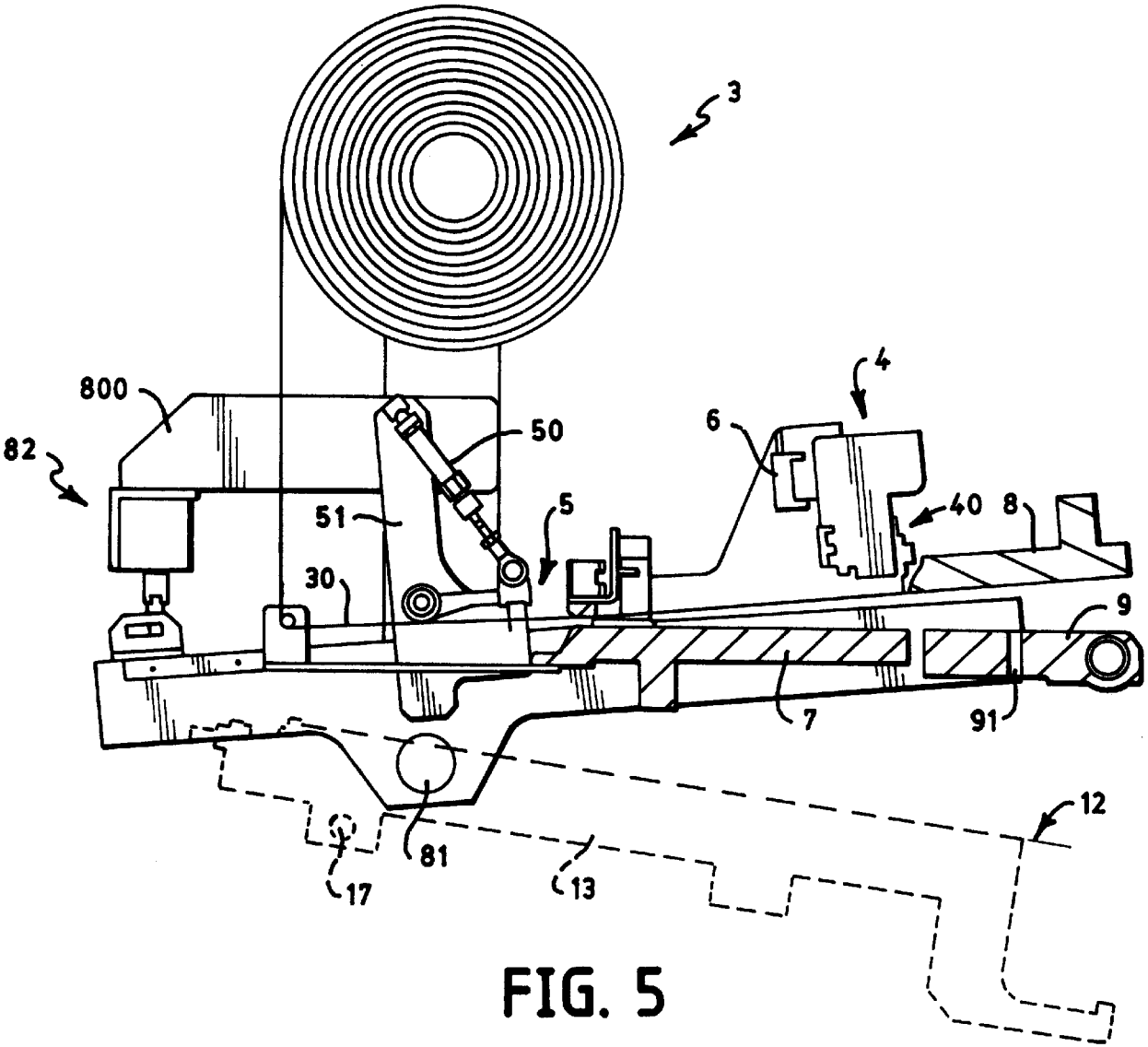
FIG. 5 shows the apparatus of FIG. 4 at the end of the ribbon movement.
Figure 6A:
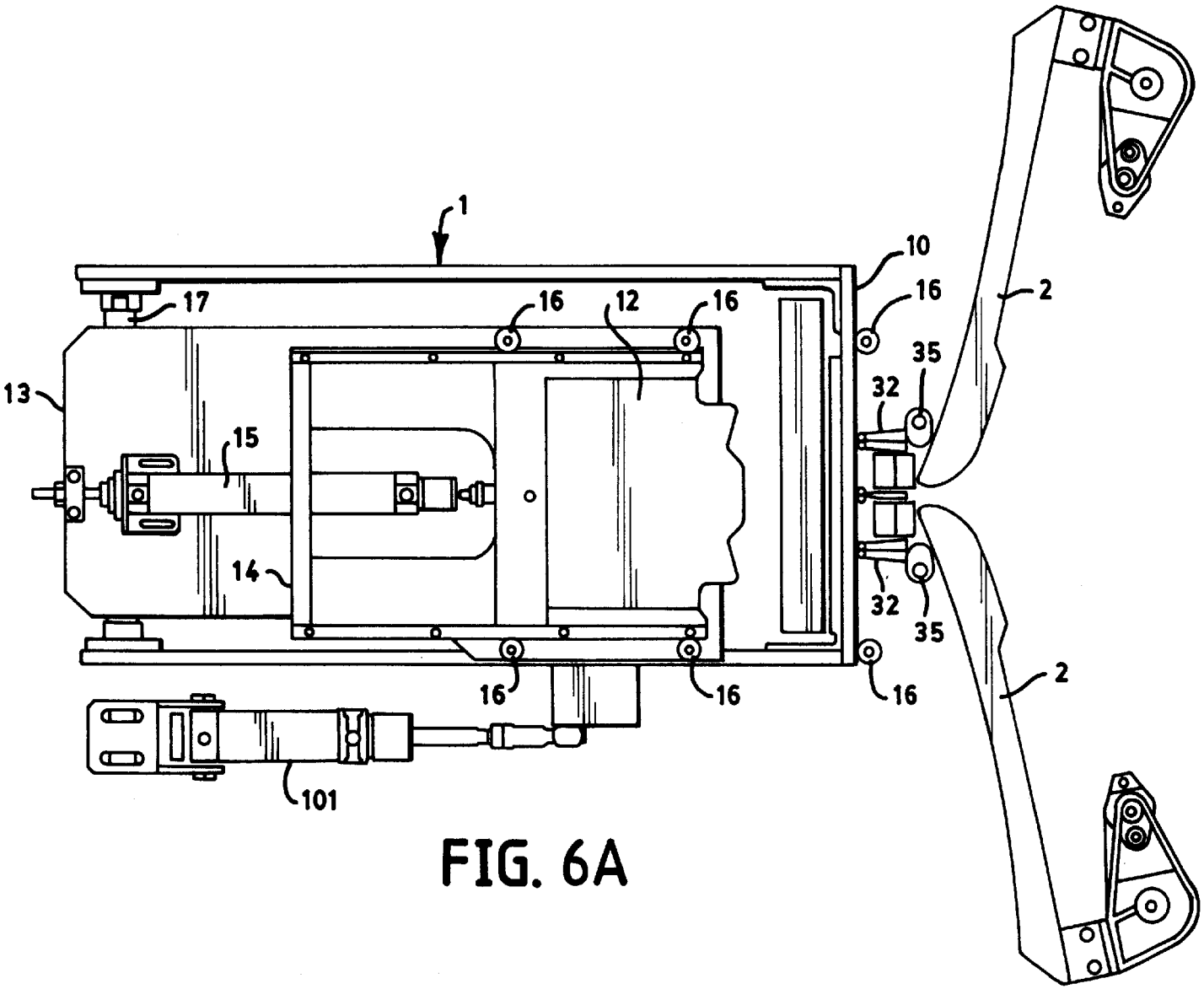
FIG. 6A is a plan view of the group for the transfer of gussets from the exit section of the apparatus to the shapes of the machine which assembles the pantyhose articles, under rest condition, that is, prior to said transfer.
Figure 6B:
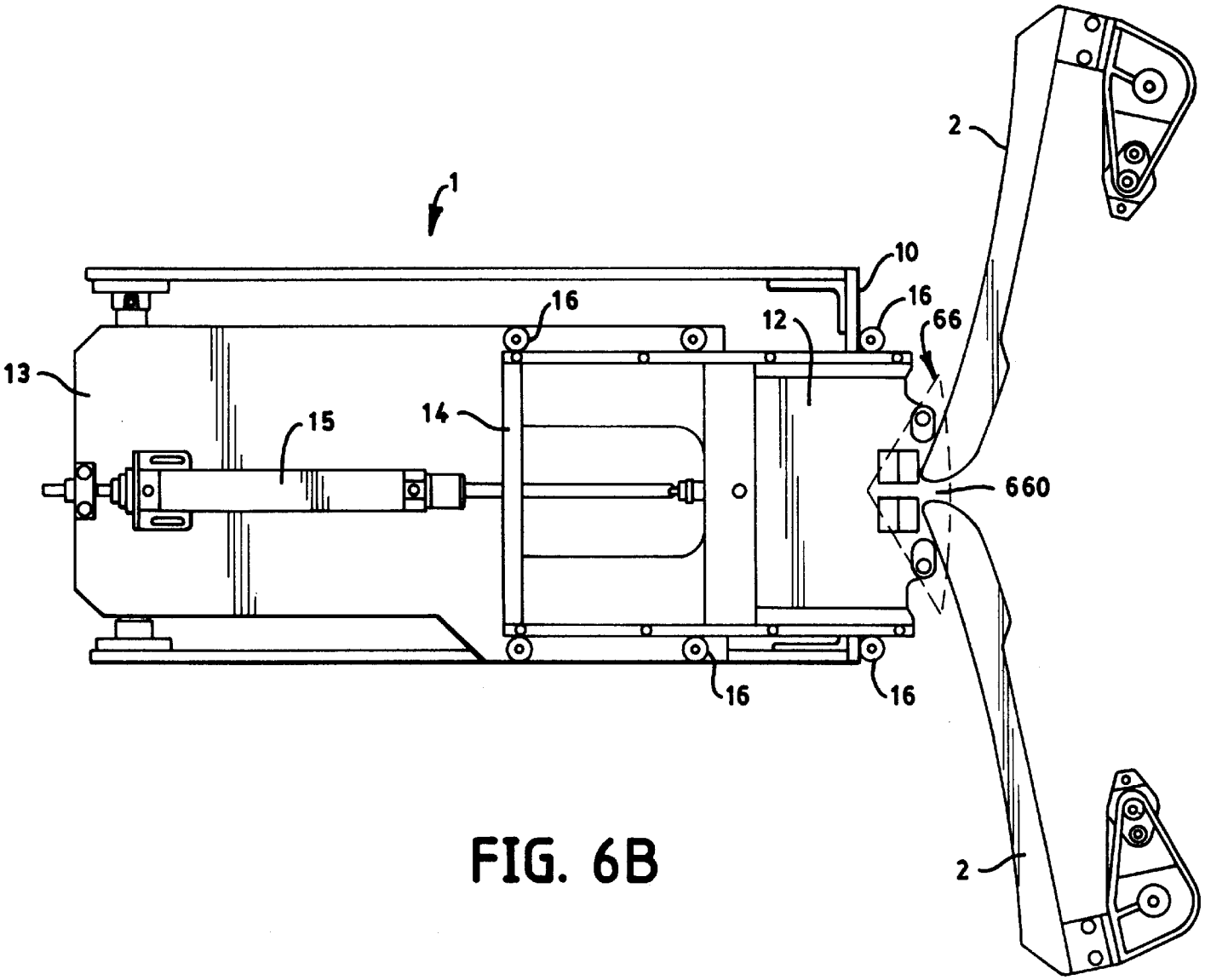
FIG. 6B shows the detail of FIG. 6A in the configuration taken up during the gusset-transfer stage.

To form the gussets (66), the ribbon (30) is engaged and moved toward the cutter (4) in order to have the free edge of the same ribbon disposed at a predetermined distance from the line of action (t) of the blade (40) (see FIGS. 4 and 5). To achieve this result, the most forward portion of the ribbon (30) is engaged by the upper suction plate (8), in which the suction is actually activated, and moved toward the cutter (4) as far as to pass (as shown in FIG. 4) the said line (t-t). In the meantime, the gripper (5) engages the ribbon (30) on the side opposite to that of the plate (8). Subsequently, this plate is made to advance, along with the gripper (5), by a length which is preset according to the dimensions of the gusset to be formed, as illustrated in FIG. 5. During this stage, the arm (80) which supports the unit (5), (4) and (8) is in raised condition, that is, rotated upwards. Then, the arm (80) is lowered, as illustrated in FIG. 1, the suction is activated in the lower plates (7) and (9), and the blade (40) of cutter (4) is operated to cut the thus positioned and retained ribbon (30) to form the desired rhomboid gusset out of it. Afterwards, with the suction being maintained in the plates (7) and (9), that is, with the gusset retained by the plate (9), and the head of the ribbon (30) retained by the plate (7), the arm (80) is rotated upwards along with the plate (8) and, after a downward rotation of the platform (13), the plate (9) is rotated downwards as in FIG. 4 (in which the apparatus is shown with the plate 9 being fully rotated, the platform 13 being already brought back in horizontal position and the plate 8 is in the process of withdrawing the head of the ribbon 30), that is, with its respective slit (91) in alignment with the slit (11) present on the front side (10) of the structure (1). With this arrangement of the apparatus, the gusset (which results astride the slit 91) is ready to be transferred to the crotch region of the pantyhose article fitted onto the shapes (2). This transfer is operated, with the platform (13) being in horizontal arrangement, by the lamina (12) whose withdrawal is operated by the actuator (15). The application of the gusset (66), which presents itself to the shapes (2) folded over the lamina (12) so as to have an upper edge (660) and a lower edge (661) both substantially of triangular shape with their base facing the shapes (2), takes place in a way known to those skilled in the art. While the gusset (66) is applied to the pantyhose, a new gusset is formed by the withdrawal and the movement of the ribbon (30), as previously indicated, with a consequent, remarkable reduction in the time of the whole cycle.

It will be appreciated that, in the procedure above exemplified, the suction in the plates (7) and (9) is activated alternately, so that, when the suction in the plate (7) is activated, the one in the plate (8) is deactivated, and vice versa.

According to the invention, provision is made advantageously that the holes of the suction plates (8) and (9) be coaxial when the same plates are in horizontal matching arrangement, with the gusset being cut interposed therebetween, to avoid the so-called "sucker effect" between the two thus disposed plates. Moreover, advantageously, the travel of the plate (8) and of gripper (5) may be broken up into more stages to offer the possibility of forming gussets of whatever suitable dimension.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. An apparatus forming a gusset from a ribbon and transferring the gusset to a pantyhose shape machine, the apparatus comprising:

a first plane surface having a first end for receiving the ribbon, said first plane surface having a second end;

a cutter positioned adjacent said second end of said first plane surface and for cutting the ribbon into a gusset;

a second plane surface movably connected to said first plane surface in a direction toward and away from said first end of said first plane surface, said second plane surface having engaging means for engaging with the ribbon;

a third plane surface arranged adjacent said cutter and on a side of said cutter diametrically opposite said first plane surface, said third plane surface having engaging means for engaging with the ribbon and the gusset, said third plane surface being movable between a first position substantially face-to-face with said second plane surface, and a second position with the gusset adjacent the shape machine for transfer of the gusset to the shape machine.

2. The apparatus in accordance with claim 1, wherein:

said engaging means of said first and second plane surfaces include suction plates.

3. The apparatus in accordance with claim 1, wherein: said first plane surface is substantially horizontal, stationary and arranged below the ribbon.

4. The apparatus in accordance with claim 1, wherein:

said second plane surface is arranged on a side of the ribbon diametrically opposite said first plane surface.

5. The apparatus in accordance with claim 1, wherein:

said first and second positions of said third plane surface are angularly spaced from each other.

6. The apparatus in accordance with claim 5, wherein:

said third plane surface is movable between said first and second positions of said third plane surface about a substantially horizontal shaft, said first position being substantially horizontal, and said second plane surface being substantially vertical.

7. The apparatus in accordance with claim 1, wherein:

said third plane surface defines a slit;

a lamina is provided and includes means for being movable through said slit, said slit and said lamina having a shape and position for said lamina to pick up the gusset and pass the gusset through said slit.

8. The apparatus in accordance with claim 1, wherein:

said second plane surface is mounted on an oscillating support.

9. A method forming a gusset from a ribbon and transferring the gusset to a pantyhose shape machine, the method comprising the steps of:

providing a first plane surface;

providing a second plane surface movable with respect to said first plane surface;

moving the ribbon along said first plane surface by engaging said second plane surface with the ribbon and moving said second plane surface away from said first plane surface from a first position to a second position of said second plane surface;

providing a third plane surface movable between a first position in substantially face-face relationship with said second plane surface and a second position adjacent the shape machine;

providing a cutter downstream of said first plane surface;

cutting the ribbon into a gusset with said cutter;

engaging the gusset with said third plane surface in said first position of said third plane surface;

moving the gusset and said third plane surface away from said second plane surface and to said second position of said third plane surface for transfer of the gusset to the shape machine.

10. The method in accordance with claim 9, wherein:

said engaging of the ribbon and the gusset by said second and third plane surfaces is performed by suction.

* * * * *